US010733893B1

(12) United States Patent
Swan

(10) Patent No.: US 10,733,893 B1
(45) Date of Patent: Aug. 4, 2020

(54) INTELLIGENT INTERSECTION CROSSWALK VULNERABLE ROAD USER WARNING SYSTEM

(71) Applicant: Continental Automotive Systems, Inc., Auburn Hills, MI (US)

(72) Inventor: Vivian Swan, Auburn Hills, MI (US)

(73) Assignee: Continental Automotive Systems, Inc., Auburn Hills, MI (US)

( * ) Notice: Subject to any disclaimer, the term of this patent is extended or adjusted under 35 U.S.C. 154(b) by 0 days.

(21) Appl. No.: 16/275,483

(22) Filed: Feb. 14, 2019

(51) Int. Cl.
*G08G 1/095* (2006.01)
*G08G 1/16* (2006.01)
*G08G 1/005* (2006.01)

(52) U.S. Cl.
CPC ..... *G08G 1/166* (2013.01); *G08G 1/005* (2013.01)

(58) Field of Classification Search
CPC ..... G08G 1/166; B60Q 1/146
USPC .... 340/944, 905, 907, 686.1, 670, 437, 463, 340/435, 438; 381/55, 56, 71.4; 701/301
See application file for complete search history.

(56) References Cited

U.S. PATENT DOCUMENTS 6,127,943 A * 10/2000 Tauchi ..... A61H 3/061 340/4.14
6,384,742 B1 * 5/2002 Harrison ..... B61L 29/24 340/917
8,903,640 B2 * 12/2014 Caminiti ..... G08G 1/0104 701/301
10,235,884 B2 * 3/2019 Song ..... H04W 4/029
2015/0109148 A1 * 4/2015 Cheatham, III ..... G08G 1/005 340/944
2019/0139413 A1 * 5/2019 Austin ..... G08G 1/07

* cited by examiner

*Primary Examiner* — Tai T Nguyen

(57) ABSTRACT

A system for warning vulnerable road users (i.e., pedestrians, cyclists, other, etc) that a vehicle or cyclist is approaching and there may be a potential danger of a collision. The system may also provides an alert to an oncoming vehicle or cyclist of the location of a vulnerable road user within a cross-walk. The system includes intelligent intersections which are enabled with dedicated short range communication ("DSRC") for detecting vehicles and vulnerable road users. This information may be received by DSRC enabled vehicles and allow the vehicles to warn the drivers of various situations which may be potentially dangerous. A plurality of lights is embedded along the edges of a crosswalk which provides an alert or signal to a vulnerable road user that a vehicle or cyclist is approaching. Sections lights may be illuminated to provide an indication of the location of the vulnerable road user within the cross-walk.

20 Claims, 3 Drawing Sheets

INTELLIGENT INTERSECTION CROSSWALK VULNERABLE ROAD USER WARNING SYSTEM

TECHNICAL FIELD

The technical field relates generally to warning vulnerable road users of a potential collision.

BACKGROUND

Signalized and unsignalized intersections and cross-walks for pedestrians present some of the most dangerous areas where accidents may occur, such as an automobile hitting a pedestrian. Additionally, pedestrians are also distracted by cell phones, tablet computers, billboards, other pedestrians, and the like, which may limit the ability of the pedestrian to be fully aware of any dangers resulting from vehicles that may be driving unsafely.

Currently, there are many types of systems in place, which are part of a vehicle, to make a driver of the vehicle aware of potential dangers with regard to collisions with pedestrians, other vehicles, and other objects along the side of a road. Some crosswalks also have systems in place which provide blinking lights to alert drivers of approaching vehicles that at least one vulnerable road user is crossing the crosswalk. However, these systems do not alert the driver of where within the crosswalk the pedestrian is located, and do not provide the vulnerable road user with any notification that a vehicle is approaching the crosswalk.

As such, it is desirable to present a warning system, which may be part of the infrastructure of an urban environment, to alert various vulnerable road users of approaching vehicles or cyclists, as well as provide an indication to the driver of a vehicle of the location of a vulnerable road user within a crosswalk. In addition, other desirable features and characteristics will become apparent from the subsequent summary and detailed description, and the appended claims, taken in conjunction with the accompanying drawings and this background.

BRIEF SUMMARY

The present invention is a system for warning vulnerable road users (i.e., pedestrians, cyclists, other, etc) that a vehicle or cyclist is approaching and there may be a potential danger of a collision, and the system also provides an alert to an oncoming vehicle or cyclist of the location of a vulnerable road user within a cross-walk.

In one embodiment, intelligent intersections may be enabled with dedicated short range communication (DSRC) for detecting vehicles and vulnerable road users, and broadcast information about them as a basic safety message (BSM). This information may be received by DSRC enabled vehicles and allow the vehicles to warn the drivers of various situations which may be potentially dangerous. In one embodiment, a plurality of lights, such as a strip of LED lights, is embedded in the concrete along the edges of a crosswalk which provides an alert or signal to a vulnerable road user that a vehicle or cyclist is approaching from one side or another. Sections of the strip of LED lights may be illuminated to provide an indication of the location of the vulnerable road user within the cross-walk. The alert or signal may also include an audio warning given over loudspeaker, for alerting the vision impaired.

Since emergency brake assist (EBA) systems have sensors that may accurately determine the location, speed, and direction of objects (pedestrians, cyclists, etc), and may be equipped with V2x technologies and communicate with the smart city infrastructures, key information may be shared to allow for localized warnings in pedestrian/cyclist areas. This information may be used to determine when to illuminate the strip of LED lights along one or both sides of a cross-walk.

In one embodiment, the present invention is a warning system for alerting a driver of at least one vehicle that at least one vulnerable road user is located within a cross-walk. The warning system includes at least one sensor operable for detecting the vulnerable road user in a detection area, at least one communication device in electrical communication with the sensor, at least one warning device in electrical communication with the communication device, and at least one alert signal produced by the warning device. The sensor and the communication device are connected to at least one infrastructure component, and the infrastructure component is located near an intersection, which includes a cross-walk. The communication device commands the warning device to produce the warning alert when the sensor detects when the vulnerable road user is crossing the cross-walk.

In one embodiment, the warning device is at least one row of lights located along a first side of the cross-walk. In another embodiment, a portion of the row of lights is illuminated which corresponds to the location of the vulnerable road user within the cross-walk.

In yet another embodiment, the warning device is a first row of lights located along a first side of the cross-walk, and a second row of lights located along a second side of the cross-walk. At least a portion of the first row of lights is illuminated when at least one vulnerable road user is located in the cross-walk and a vehicle is located on the first side of the cross-walk. Furthermore, at least a portion of the second row of lights is illuminated when at least one vulnerable road user is located in the cross-walk and a vehicle is located on the second side of the cross-walk.

In an embodiment, a portion of the first row of lights is illuminated which corresponds to the location of the vulnerable road user within the cross-walk, and a portion of the second row of lights is illuminated which corresponds to the location of the vulnerable road user within the cross-walk.

In an embodiment, the first row of lights and the second row of lights are LED lights, but it is within the scope of the invention that other types of lights may be used.

The sensor may be any type of suitable sensor, such as, but not limited to, long-range radar, short-range radar, LIDAR (Light Imaging, Detection, and Ranging), LADAR (Laser Imaging, Detection, and Ranging), camera, ultrasound, and sonar.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

Other advantages of the disclosed subject matter will be readily appreciated, as the same becomes better understood by reference to the following detailed description when considered in connection with the accompanying drawings wherein.

DETAILED DESCRIPTION

Figure 1:
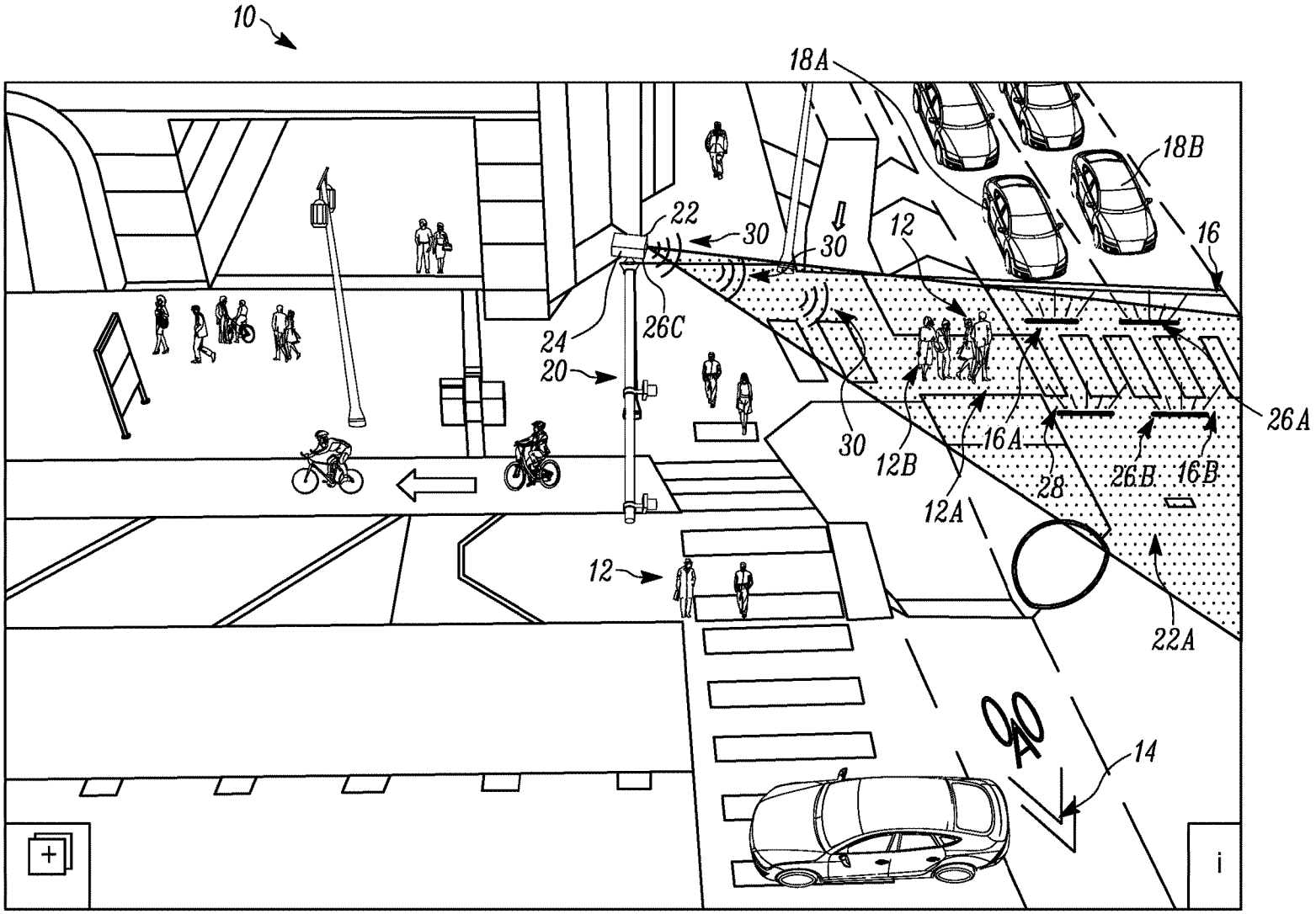
FIG. 1 is a perspective view of a traffic intersection having a warning system being part of an infrastructure component, according to embodiments of the present invention.

The following description is merely exemplary in nature and is in no way intended to limit the invention, its application, or uses.

An example of a system for warning vulnerable road users ("VRUs") is shown in the Figures generally at 10. There are also several vulnerable road users VRUs, shown generally at 12, travelling near an intersection, shown generally at 14. More specifically, there are two vulnerable road users 12A, 12B attempting to cross the intersection 14 at a cross-walk, shown generally at 16. A first vehicle 18A is stopped near the cross-walk 16, and a second vehicle 18B is moving towards the intersection 14 in a direction that is perpendicular to the direction of travel of each of the VRUs 12A, 12B.

The warning system 10 includes some type of infrastructure component, which in this exemplary embodiment is a post 20, having at least one sensor 22, at least one communication device 24, and at least one warning device, of which several embodiments are shown in the Figures. While in this embodiment, the infrastructure component is the post 20, it is within the scope of the invention that the warning system 10 may include any other type of infrastructure component, including, but not limited to, a building, bridge, parking structure, support structure, or the like. In this embodiment, the communication device 24 is enabled with dedicated short-range communication ("DSRC") for detecting vehicles and vulnerable road users. In this embodiment, the sensor 22 and communication device 24 are integrated into a single component (not numbered), but it is within the scope of the invention that the sensor 22 and communication device 24 may be separate components in the same or different locations. The sensor 22 in this embodiment is configured to detect objects in a detection area, shown generally at 22A. In one embodiment, the sensor 22 is a long-range radar sensor 22, but it is within the scope of the invention that other types of sensors maybe used, such as, but not limited to, LIDAR (i.e., light imaging, detection, and ranging), LADAR (i.e., laser imaging, detection, and ranging), other types of radar, a camera, ultrasound, or sonar.

In the example shown in the Figures, the first vehicle 18A is blocking the view of each VRU 12A, 12B crossing the intersection 14, such that each VRU 12A, 12B is unable to see the second vehicle 18B approaching the intersection 14. If each VRU 12A, 12B continues to walk through the intersection 14 unaware of the path of travel of the second vehicle 18B, or the driver of the vehicle 18B is unaware that the VRUs 12A, 12B are attempting to walk through the intersection 14, the second vehicle 18B may collide with and seriously injure or kill one of the VRUs 12A, 12B. However, the system 10 of the present invention includes the sensor 22 which sends a signal to the communication device 24 providing an indication of the location, speed, and direction of any object (either pedestrian or vehicle) in the detection area 22A.

In the Figures, the sensor 22 is capable of detecting the location, as well as speed and direction of each vehicle 18A,18B, and the location, speed, and direction of each VRU 12A, 12B. While there are two VRUs 12A, 12B which are walking in the example shown in FIGS. 1 and 2, it is within the scope of the invention that the sensor 22 is able to detect if each VRU 12 is walking, traveling by bicycle, scooter, skateboard, rollerblades, or the like. In one embodiment, the warning device is a plurality of lights, or more specifically a first row of LED lights shown generally 26A in FIGS. 1 and 2, and a second row of LED lights, shown generally at 26B in FIGS. 1 and 2, which provide a first example of an alert signal, shown generally at 28, which is the light produced from each of the rows of LED lights 26A,26B. The first row of LED lights 26A is located on a first side 16A of the cross-walk 16, and the second row of LED lights 26B is located on a second side 16B of the cross-walk 16.

Once the sensor 22 detects the location, as well as speed and direction of each vehicle 18A,18B, and the location, speed, and direction of each VRU 12A, 12B, the communication device 24 commands the warning devices 26A,26B to produce the alert signal 28. In the example embodiment shown in FIGS. 1 and 2, once one or more of the VRUs 12A, 12B have begun to cross the intersection 14, one or more the first plurality of lights 26A is illuminated, producing the alert signal 28. The first plurality of lights 26A are illuminated to provide an alert to one or both of the oncoming vehicles 18A,18B that one or both of the VRUs 12A, 12B are crossing the intersection 14. The selection of which of the plurality of lights 26A,26B are illuminated is chosen based on which side 16A,16B of the cross-walk 16 is being approached by a vehicle or cyclist. If the first side 16A of the cross-walk 16 is being approached by a vehicle or cyclist, one or more of the first plurality of lights 26A is illuminated, and if the second side of the cross-walk 16 is being approached by a vehicle or cyclist, then one or more of the second plurality of lights 26B is illuminated. The illumination of one or more of the plurality of lights 26A,26B provides the alert signal 28 to each driver of the vehicles 18A,18B that at least one of the VRUs 12A, 12B is crossing the cross-walk 16.

Figure 2:
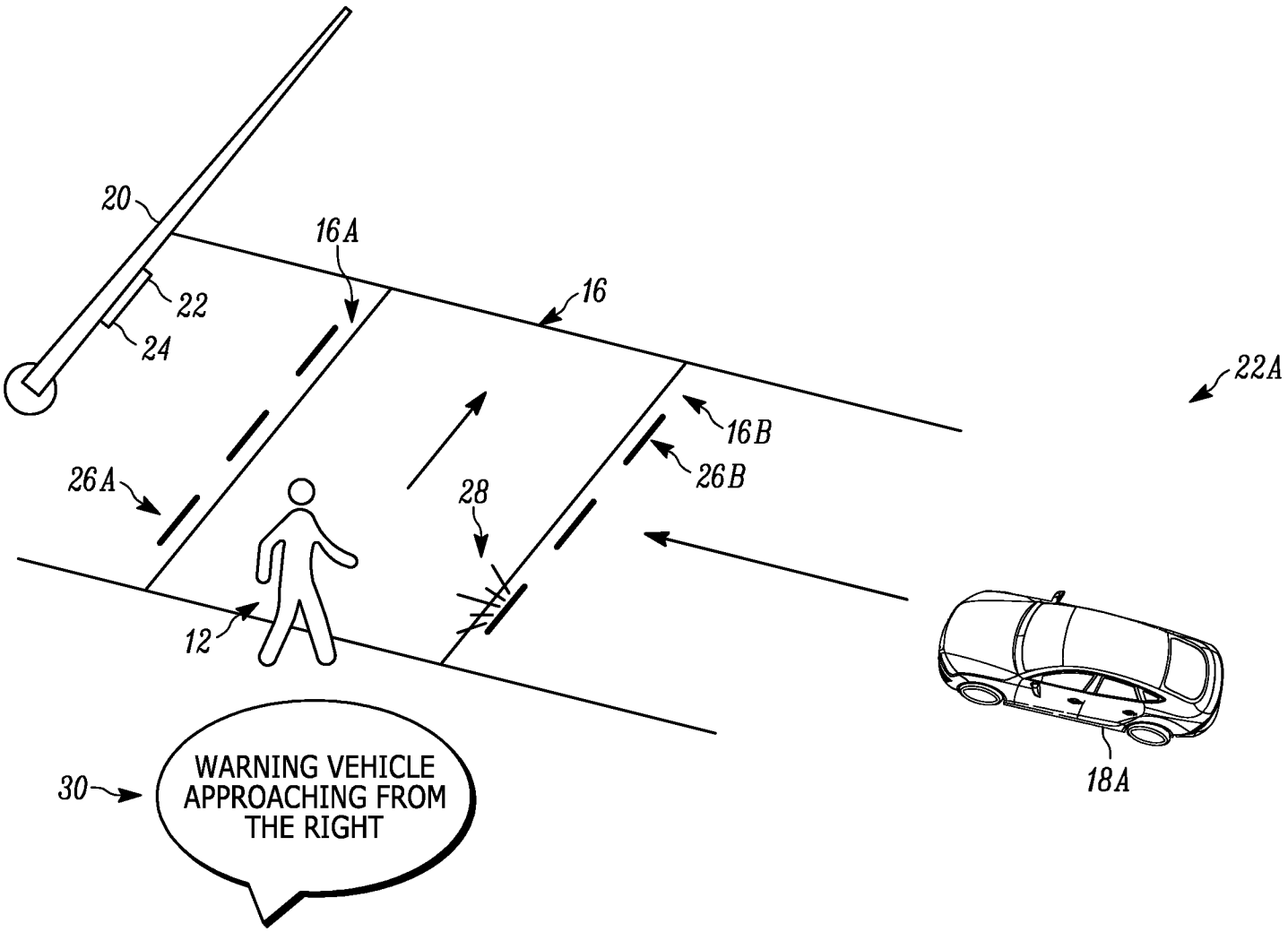
FIG. 2 is a first diagram of a vulnerable road user entering a crosswalk having a warning system being part of an infrastructure component, according to embodiments of the present invention.

Additionally, a signal is sent to the communication device 24, such that the communication device 24 sends a signal to another warning device 26C to alert each VRU 12A, 12B that there is a potential danger of collision with the vehicle 18B. The warning device 26C shown in FIG. 1 is integrated into the same component as the sensor 22 and communication device 24, but it is within the scope of the invention that the warning device 26C may be a separate component. The warning device 26C then sends out another type of alert signal, an example of which is indicated generally at 30, indicating to each VRU 12A, 12B that one or more of the vehicles 18A,18B is approaching the cross-walk 16. This provides an awareness to each VRU 12A, 12B such that each VRU 12A, 12B may take measures if need be to avoid entering the cross-walk 16 if one or more of the vehicles 18A,18B is approaching the cross-walk 16 at an unsafe speed. The warning device 26C may be equipped to send out different types of alert signals 30, such as, but not limited to, an audible sound warning or a visual warning as shown in FIGS. 1 and 2, or in some embodiments, a haptic warning. In other embodiments, the alert signals 28,30 may accommodate any type of VRU 12 traveling under various conditions. For example the VRU 12 may be deaf, listening to headphones, or have limited hearing ability due to some other condition, and require the alert signals 28,30 to provide a visual, or in some embodiments, a haptic warning.

Figure 3:
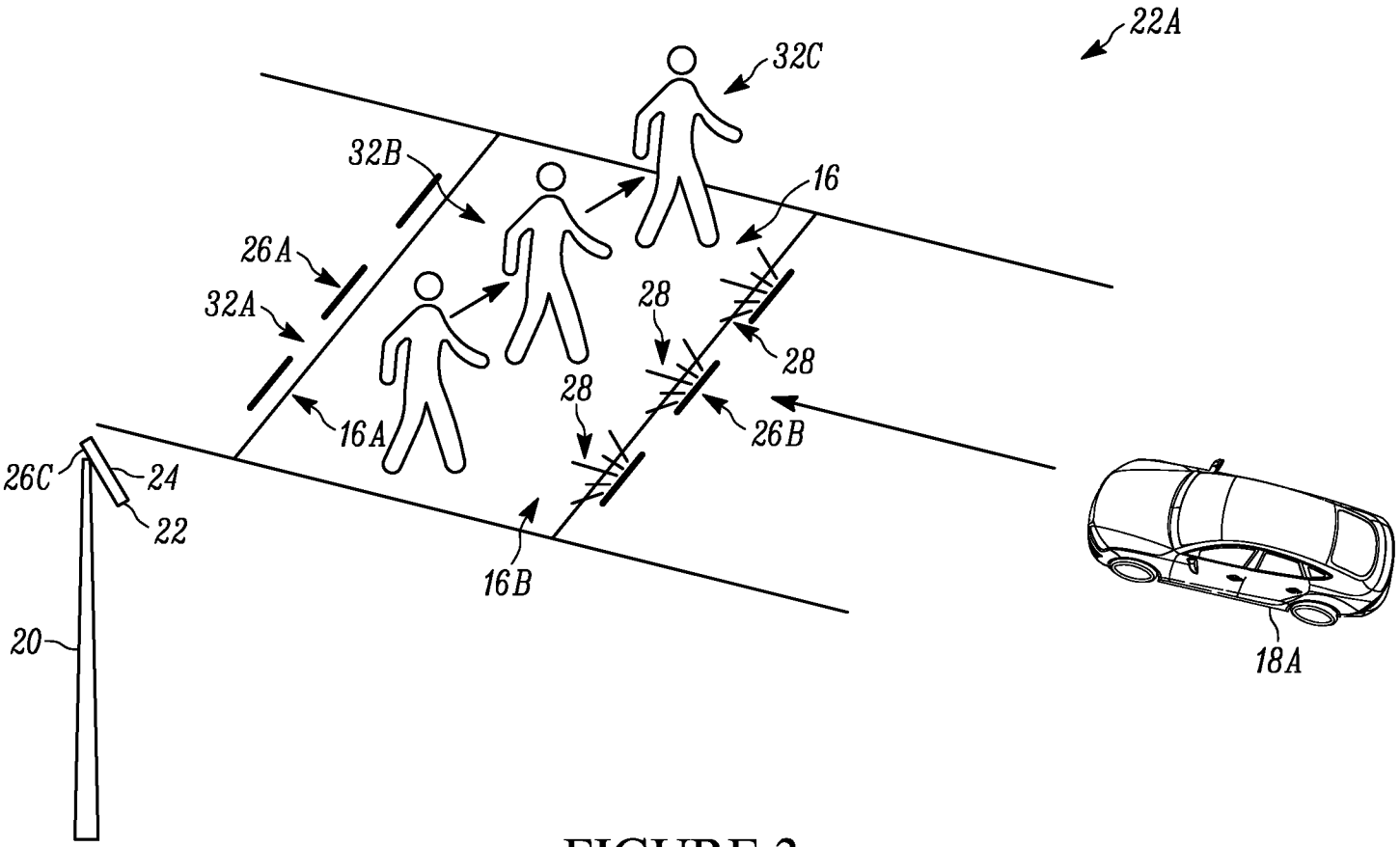
FIG. 3 is a second diagram of a vulnerable road user entering a crosswalk having a warning system being part of an infrastructure component, according to embodiments of the present invention.

Another embodiment of the invention is shown in FIG. 3, with like numbers referring to like elements. In this embodiment, both the first row of LED lights 26A and the second row of LED lights 26B have a progressive illumination function. The first VRU 12A is shown crossing the cross-walk 16, with different portions of the second row of LED lights 26B illuminated as the VRU 12A crosses the cross-walk. More specifically, in FIG. 3 the first VRU 12A is shown in a first position, shown generally at 32A, a second position, shown generally at 32B, and a third position, shown generally at 32C, with the portion of the second row of LED lights 26B illuminated corresponding to the location of the VRU 12A within the cross-walk 16.

In one embodiment, the communication device 24 is a dedicated short range communication (DSRC) device 24, but it is within the scope of the invention that other types of communication devices maybe used.

Some intersections include a device, such as a button, for initiating a change in a traffic signal to provide the VRU's 12A, 12B an opportunity to cross the intersection 14. In an alternate embodiment, the row of LED lights 26A,26B may be illuminated in response to one of the VRU's 12A, 12B pressing the button to initiate the change in the traffic signal.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An apparatus, comprising:

a warning system, including:

at least one sensor operable for detecting at least one vulnerable road user and at least one vehicle in a detection area, at least a portion of an intersection located within the detection area;

at least one communication device in communication with the at least one sensor;

at least one warning device in communication with the communication device and capable of producing at least one alert signal;

wherein the communication device commands the at least one warning device to produce the at least one alert signal when the at least one sensor detects when the at least one vulnerable road user is crossing the intersection at a cross-walk;

wherein the at least one warning device includes a plurality of lights arranged in proximity to the intersection, and wherein at least a portion of the plurality of lights are operable to illuminate corresponding to a location of the at least one vulnerable road user within the cross-walk.

2. The apparatus of claim 1, wherein the plurality of lights further comprises a row of lights.

3. The apparatus of claim 2, wherein a cross-walk is located in proximity to the intersection, wherein the row of lights is located along one side of the cross-walk.

4. The apparatus of claim 2, wherein the row of lights further comprises a row of light emitting diodes.

5. The warning system of claim 2, wherein the row of lights are embedded in concrete along the edges of the cross-walk.

6. The apparatus of claim 1, the at least one sensor being one selected from the group consisting of long-range radar, short-range radar, LIDAR, LADAR, camera, ultrasound, and sonar.

7. The warning system of claim 1, wherein the plurality of lights progressively illuminate with respect to the location of the at least one vulnerable road user within the cross-walk as the at least one vulnerable road user moves across the cross-walk.

8. The warning system of claim 1, wherein at least a portion of the plurality of lights illuminate on a respective side of a cross-walk corresponding to a location of a vehicle or cyclist approaching the cross-walk.

9. The warning system of claim 1, wherein the intersection includes a device having a button for initiating a change in traffic signal, the at least one portion of the plurality of light illuminating in response the at least one vulnerable user pressing the button.

10. The warning system of claim 1, wherein the at least one warning device further produces a warning alert communicated to the at least one vulnerable road user when the at least one vehicle is approaching the cross-walk.

11. The warning system of claim 10, wherein the warning alert communicated to the at least one vulnerable road user is an audible sound warning.

12. The warning system of claim 10, wherein the warning alert communicated to the at least one vulnerable road user is a haptic warning.

13. A warning system for alerting a driver of at least one vehicle that at least one vulnerable road user is located within a cross-walk, the system comprising:

an infrastructure component located near the cross-walk;

at least one sensor coupled to the infrastructure component and operable for detecting at least one vulnerable road user and at least one vehicle in a detection area;

at least one communication device coupled to the infrastructure component and in communication with the at least one sensor;

at least one warning device in communication with the communication device;

at least one alert signal produced by the at least one warning device;

wherein the communication device commands the at least one warning device to produce the at least one warning alert when the at least one sensor detects when the at least one vulnerable road user is crossing the cross-walk;

wherein the at least one warning device includes a plurality of lights arranged in proximity to the intersection, and wherein at least a portion of the plurality of lights are operable to illuminate corresponding to a location of the at least one vulnerable road user within the cross-walk.

14. The warning system of claim 13, the at least one warning device further comprising at least one row of lights located along a first side of the cross-walk.

15. The warning system of claim 13, the at least one warning device further comprising:

a first row of lights located along a first side of the cross-walk;

a second row of lights located along a second side of the cross-walk;

wherein at least a portion of the first row of lights is illuminated when the at least one vulnerable road user is located in the cross-walk and a vehicle is located on the first side of the cross-walk, and at least a portion of the second row of lights is illuminated when at least one vulnerable road user is located in the cross-walk and a vehicle is located on the second side of the cross-walk.

16. The warning system of claim 15, the first row of lights further comprising first row of light emitting diodes, and the second row of lights further comprising a second row of light emitting diodes.

17. The warning system of claim 15, wherein a portion of the first row of lights is illuminated which corresponds to the location of the vulnerable road user within the cross-walk.

18. The warning system of claim 15, wherein a portion of the second row of lights is illuminated which corresponds to the location of the vulnerable road user within the cross-walk.

19. The warning system of claim 13, the at least one sensor being one selected from the group consisting of long-range radar, short-range radar, LIDAR, LADAR, camera, ultrasound, and sonar.

20. The warning system of claim 15, wherein the plurality of lights in the illuminated row progressively illuminate with respect to the location of the at least one vulnerable road user within the cross-walk as the at least one vulnerable road user moves across the cross-walk.

* * * * *